US005078734A

United States Patent [19]

Noble

[11] Patent Number: 5,078,734

[45] Date of Patent: Jan. 7, 1992

[54] MEDICATION DISPENSING PACIFIER

[76] Inventor: David E. Noble, 720 Centennial St., Sewickley, Pa. 15143

[21] Appl. No.: 600,700

[22] Filed: Oct. 22, 1990

[51] Int. Cl.[5] ..... A61J 17/00

[52] U.S. Cl. ..... 606/236; 606/234; 606/235; 606/77; 215/11.1

[58] Field of Search ..... 604/77; 215/11.1, 11.2, 215/11.3, 11.4, 11.5, 11.6; 606/234, 235, 236

[56] References Cited

U.S. PATENT DOCUMENTS

| | | | |
|---|---|---|---|
| 1,582,003 | 4/1926 | Griffiths . | |
| 2,612,165 | 9/1952 | Szuderski . | |
| 2,824,561 | 2/1958 | Mueller . | |
| 2,889,829 | 6/1959 | Tannenbaum et al. | 606/236 |
| 3,077,279 | 2/1963 | Mitchell | 215/11.1 |
| 4,192,307 | 3/1980 | Baer . | |
| 4,878,496 | 11/1989 | Chen | 606/234 |
| 5,013,321 | 5/1991 | MacVane | 606/234 |

FOREIGN PATENT DOCUMENTS

| | | | |
|---|---|---|---|
| 0536196 | 5/1941 | United Kingdom | 606/236 |

*Primary Examiner*—Stephen C. Pellegrino
*Assistant Examiner*—Glenn K. Dawson
*Attorney, Agent, or Firm*—Norman B. Rainer

[57] ABSTRACT

An infant's pacifier is constructed in a manner to confine and administer a beneficial liquid composition. The pacifier has a hollow nipple which threadably joins with a base that may serve as a funnel for expediting entrance of liquid into the nipple. The base is in turn threadably attached to a cap which has provision for admitting air to the nipple. A handle may be attached to the cap. The base, which is generally perpendicular to the nipple, may have indentations to accommodate an infant's nose.

8 Claims, 2 Drawing Sheets

MEDICATION DISPENSING PACIFIER

BACKGROUND OF THE INVENTION

This invention relates to infant pacifiers, and more particularly concerns a pacifier adapted to deliver medication or nutritional substances to infants through a sucking action.

Pacifiers are made according to various types and are usually nipple-shaped. They are used to appease crying children or to discourage thumb-sucking and other idiosyncrasies. Very often the pacifier is dipped in honey, syrup, or topical oral medication to tranquilize the infant. Unfortunately, the effect is only short-lived, for the dipped coating is rapidly diluted by saliva, and the pacifier has to be dipped repeatedly.

It is generally difficult to orally administer to babies and infants medicines or vitamins, particularly those having unpleasant taste or aroma. Various container type porous and non-porous pacifiers have been disclosed in the prior art which provide containment and delivery means for medication or nutritious substances. For example, U.S. Pat. Nos. 2,889,829; 4,192,307; 2,612,165, and 2,824,561 disclose numerous embodiments of pacifiers characterized by having perforated or microporous hollow nipples and containment means for viscous liquid medications or nutrients. The liquid is dispensed from said containment means and drawn through the nipple by the suckling of the infant.

Such pacifiers, although adapted for the administration of medicines generally in liquid form, do not provide for the accurate measuring of the dosage of said medicines. Furthermore, the filling of the containment reservoir is often difficult, and spillage and waste of medicine occurs. Some medications must be administered in accurate doses. In the case of a microporous nipple, the suckling of the infant will collapse the nipple and not allow the infant to ingest a complete dosage.

It is therefore an object of the present invention to provide a reservoir type pacifier which may be easily and accurately filled with a specific dosage of medication.

It is another object of this invention to provide a pacifier of the aforesaid nature which will alternatively accommodate a prepackaged unit dosage of medication.

It is a yet another object of the present invention to provide a pacifier of the aforesaid nature which will not collapse due to the suckling of an infant.

It is a further object of this invention to provide a pacifier of the aforesaid nature amenable to easy cleaning and sterilization.

These objects and other objects and advantages of the invention will be apparent from the following description.

SUMMARY OF THE INVENTION

The above and other beneficial objects and advantages are accomplished in accordance with the present invention by a pacifier adapted for the containment and administration of liquid medication, said pacifier comprised of:

a) a hollow, elongated nipple having an interior reservoir bounded in part by closed distal and open proximal extremities, said nipple constructed of elastic material and having an axis of symmetry extending between said extremities, and measuring indicia orthogonal to said axis at spaced intervals between said extremities, said proximal extremity having a cylindrical sleeve provided with external threading and a bore centered upon said axis.

b) a base comprised of a panel disposed orthogonally to said axis, and having threaded central aperture means configured to engage said sleeve, and a continuous retaining wall upraised from said panel and thereby defining an enclosure which can funnel liquid into said nipple when said axis is vertically disposed, and c) a cap having a threaded stem configured to enter said central aperture means and achieve impervious communication with said sleeve, and an air passage valve adapted to allow air to be drawn through said cap into said nipple.

In a preferred embodiment, the cap may have an annular handle ring.

In another preferred embodiment the base may be shaped to conform to an infant's mouth, having one or more indentations in said panel and retaining wall to accommodate the infant's nose to facilitate easy breathing.

In certain embodiments, the nipple may be constructed from a non-porous material and may have one or more small delivery openings to permit passage of liquids. In other embodiments, the nipple may function as a disposable packaging means for a medication, and may be punctured at the time of use. In other applications, the nipple may contain a freezable liquid which serves to sooth the gums of teething infants.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
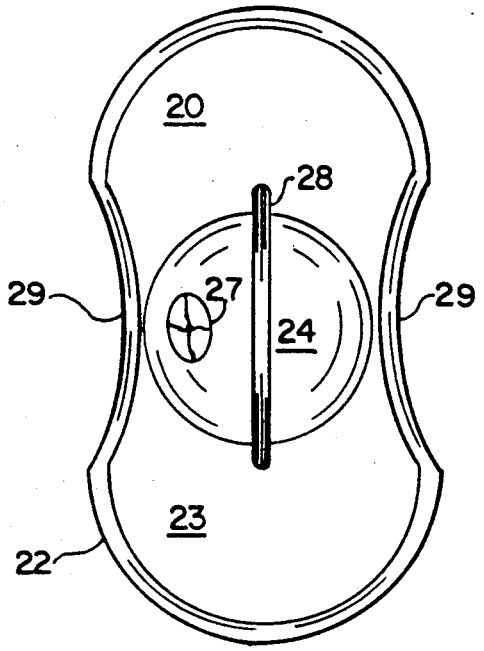
FIG. 1 is a top view of an embodiment of the apparatus of the present invention.
Figure 2:
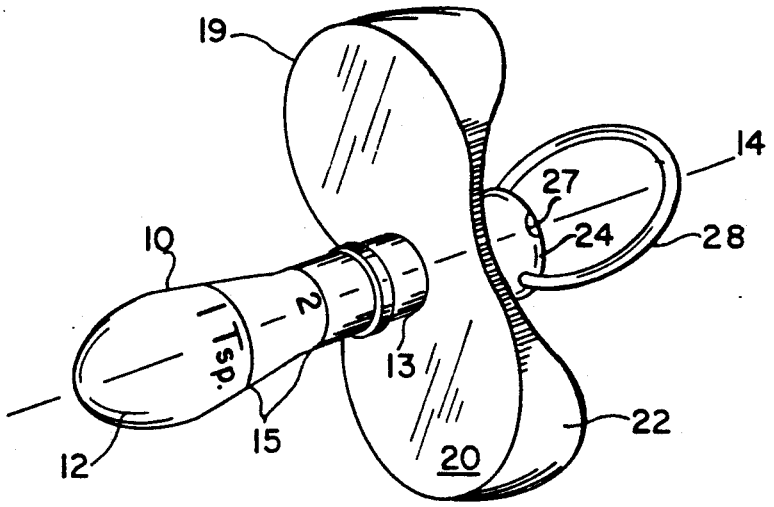
FIG. 2 is a perspective view of the embodiment of FIG. 1.
Figure 3:
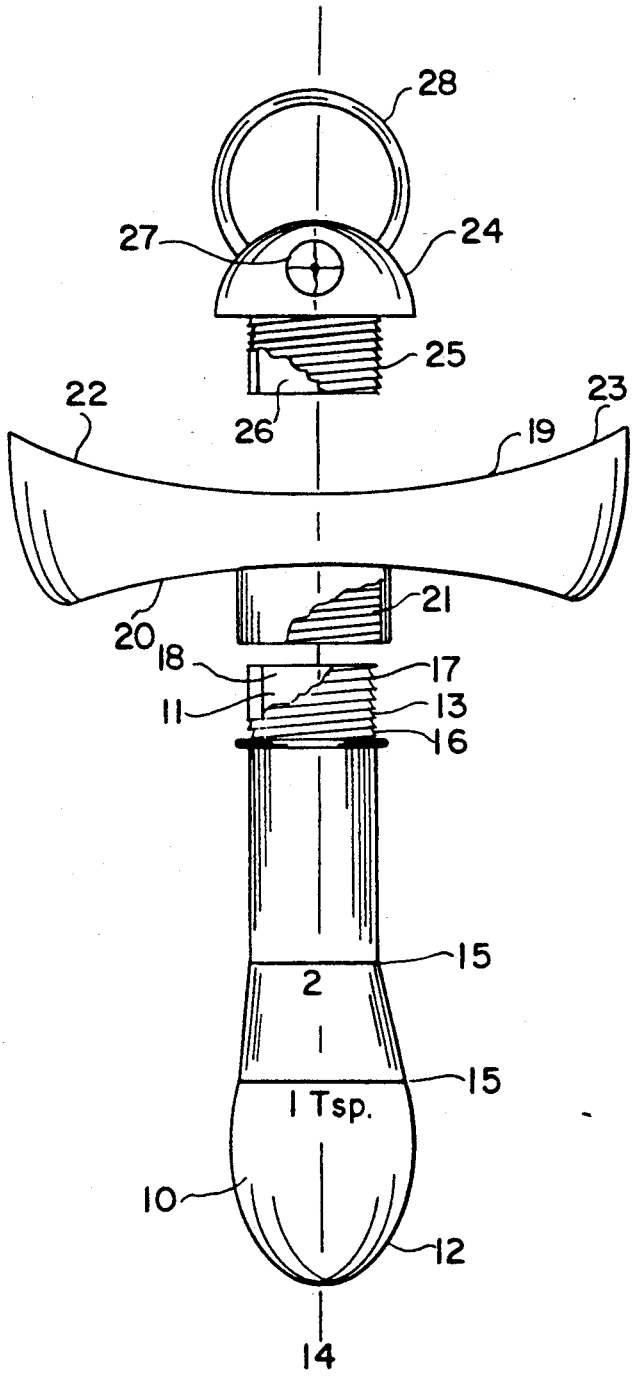
FIG. 3 is an exploded side view of the embodiment of FIG. 1.

Referring to FIGS. 1-3, an embodiment of the apparatus of the present invention is shown comprised of a pacifier adapted for the containment and administration of liquid medication. The pacifier is comprised of hollow, elongated nipple 10 having interior reservoir 11 bounded in part by closed distal and open proximal extremities 12 and 13, respectively. Nipple 10 is constructed of microporous translucent elastic sheet material and has an axis of symmetry 14 extending between extremities 12 and 13. Measuring indicia 15 are orthogonal to axis 14 at spaced intervals between extremities 12 and 13. Proximal extremity 13 terminates in cylindrical sleeve 16 having external threading 17 and a bore 18 centered upon axis 14.

Base 19 is comprised of panel 20 disposed orthogonally to said axis 14. Panel 20 has threaded central aperture means in the form of internally threaded tube 21 adapted to engage sleeve 16. Continuous retaining wall 22 is upraised from panel 20 and defines enclosure 23 which can funnel liquid into nipple 10 when axis 14 is vertically disposed. Cap 24 has an externally threaded stem 25 adapted to penetrate central aperture means 21 and achieve impervious communication with the nipple. Hollow chamber 26 has air passage valve 27 adapted to allow air to be drawn into hollow chamber 26. Cap 24 has associated annular handle ring 28 adapted to be grasped by an infant.

Base 19 is shaped to conform to an infant's mouth, having indentations 29 in panel 20 and retaining wall 22 to accommodate the infant's nose to facilitate easy breathing.

Because of the take-apart nature of the device, cleaning and sterilization is facilitated. In those instances where the nipple is pre-filled, as by a pharmacist, greater safety is provided in terms of the dosage of medication administered. In order to assure that no leakage of fluid occurs in the region of the threaded connectors, an O-ring may be disposed within threaded tube 21.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An infant's pacifier for the containment and administration of liquid, said pacifier comprised of:

a) a hollow elongated nipple having an interior reservoir bounded in part by closed distal and open proximal extremities, said nipple constructed of elastic material, having an axis of symmetry extending between said extremities, and having measuring indicia orthogonal to said axis at spaced intervals between said extremities, said proximal extremity having a cylindrical sleeve provided with external threading and a bore centered upon said axis, b) a base comprised of a panel disposed orthogonally to said axis, and having threaded central aperture means configured to engage said sleeve, and a continuous retaining wall upraised from said panel and thereby defining an enclosure which can funnel liquid into said nipple when said axis is vertically disposed, and c) a cap having a threaded stem configured to enter said central aperture means to achieve impervious communication with said sleeve, and an air passage valve adapted to allow air to be drawn through said cap into said nipple.

2. The pacifier of claim 1 wherein said cap is provided with a handle.

3. The pacifier of claim 2 wherein said handle has a ring-like configuration.

4. The pacifier of claim 1 wherein said base is provided with at least one indentation adjacent said axis, said indentation configured to accommodate the infant's nose.

5. The pacifier of claim 1 wherein the distal extremity of said nipple has at least one small opening to permit passage of liquid.

6. The pacifier of claim 1 wherein the nipple is impermeable and is utilized, in conjunction with said base and cap, as a disposable packaging means for a liquid.

7. The pacifier of claim 6 further containing a liquid confined within said nipple.

8. The pacifier of claim 7 wherein said liquid is a medication intended to be administered to an infant in carefully controlled dosage amount.

* * * * *